US012654895B2

(12) United States Patent
Davidson et al.

(10) Patent No.: US 12,654,895 B2
(45) Date of Patent: Jun. 16, 2026

(54) HEAT-SEALING APPARATUS FOR WRAPPING ARTICLES

(71) Applicant: BW Flexible Systems, Duncan, SC (US)

(72) Inventors: Mark Davidson, Greer, SC (US); Joshua Riddle, Campobello, SC (US); Adrianus Claessens, Duncan, SC (US)

(73) Assignee: Barry-Wehmiller, Inc., Duncan, SC (US)

( * ) Notice: Subject to any disclaimer, the term of this patent is extended or adjusted under 35 U.S.C. 154(b) by 0 days.

(21) Appl. No.: 19/180,888

(22) Filed: Apr. 16, 2025

(65) Prior Publication Data

US 2025/0326511 A1 Oct. 23, 2025

Related U.S. Application Data

(60) Provisional application No. 63/636,572, filed on Apr. 19, 2024.

(51) Int. Cl.
*B65B 51/16* (2006.01)

(52) U.S. Cl.
CPC ..... *B65B 51/16* (2013.01)

(58) Field of Classification Search
CPC ..... B29C 66/1122; B29C 66/849; B29C 66/4312; B29C 66/83543; B29C 65/18; B29C 65/7885; B65B 51/306; B65B 51/30; B65B 51/10; B65B 51/16; B65B 51/26; B65B 43/465; B65B 9/207; B31B 70/642
See application file for complete search history.

(56) References Cited

U.S. PATENT DOCUMENTS 3,943,683 A * 3/1976 Kovacs ..... B65B 51/30 53/550
3,950,205 A * 4/1976 Hawkins ..... B29C 66/4322 156/251
4,050,372 A * 9/1977 Kobiella ..... B29C 66/8227 100/33 PB
4,094,124 A * 6/1978 Ljungcrantz ..... B65B 3/02 493/84
4,199,919 A * 4/1980 Moscatelli ..... B29C 65/224 53/374.6
4,305,240 A * 12/1981 Grevich ..... B65B 51/30 53/550

(Continued)

OTHER PUBLICATIONS

European Search Report for European Application No. 25 17 1467 dated Jul. 16, 2025.

*Primary Examiner* — Dariush Seif
(74) *Attorney, Agent, or Firm* — Wood, Phillips, Katz, Clark & Mortimer

(57) ABSTRACT

The present invention is directed to a heat-sealing apparatus of a flow wrapper machine which facilitates efficient, reliable and versatile operation. Notably, the apparatus includes multiple ring gears driven by multiple servo motors in a desirably compact configuration, with the arrangement including quickly removable heat-sealing die heads for efficient operation and service. The improved drive mechanism facilitates more accurate heat-sealing head placement, smoother operation, controlled stops, independent temperature control, and continuous running through die jams. Also included is a four-bar link on the heat-sealing head for opening and closing the heat-sealing dies.

5 Claims, 6 Drawing Sheets

(56) References Cited

U.S. PATENT DOCUMENTS 4,723,393 A * 2/1988 Silbernagel ..... B65B 11/008 53/210
5,212,933 A * 5/1993 Cere' ..... B65B 11/045 53/556
5,660,674 A * 8/1997 Saindon ..... G01N 21/89 493/208
5,768,862 A * 6/1998 Mauro ..... B65B 11/025 53/556
6,138,442 A * 10/2000 Howard ..... B29C 66/8222 53/551
6,223,506 B1 * 5/2001 Ghini ..... B65B 51/14 53/232
6,487,831 B1 * 12/2002 Turra ..... B65B 51/16 53/234
6,516,589 B1 * 2/2003 Draghetti ..... B65B 11/42 53/466
9,796,493 B2 * 10/2017 Casadei ..... B65B 65/02
12,496,797 B2 * 12/2025 Rymer ..... B31B 70/642
2005/0044677 A1 * 3/2005 Colson ..... B32B 5/26 28/101
2006/0201113 A1 * 9/2006 Conti ..... B65B 29/025 53/529
2007/0180794 A1 * 8/2007 Paunesku ..... B65B 43/04 53/562
2008/0184676 A1 * 8/2008 Downhill ..... B65B 11/008 53/465
2014/0150383 A1 * 6/2014 Okamoto ..... B65B 13/12 53/589
2017/0107007 A1 * 4/2017 Valli ..... B29C 66/849
2022/0063852 A1 * 3/2022 Rydlewski ..... B29C 66/244
2022/0290743 A1 * 9/2022 Sutton ..... B65B 65/02
2022/0396018 A1 * 12/2022 Hansen ..... B29C 45/281
2024/0025130 A1 * 1/2024 Latronico ..... B65B 51/30
2024/0076082 A1 * 3/2024 Ferrari ..... B65B 7/02
2025/0326511 A1 * 10/2025 Davidson ..... B29C 65/7894

* cited by examiner

HEAT-SEALING APPARATUS FOR WRAPPING ARTICLES

CROSS-REFERENCE TO RELATED APPLICATION

This application is a non-provisional, which claims priority of Provisional Application Ser. No. 63/636,572 filed Apr. 19, 2024, the disclosure of which is hereby incorporated by reference in its entirety.

FIELD OF THE INVENTION

The present invention is directed toward a heat-sealing apparatus that can be used attendant to packaging and heat-sealing of a plurality of articles, and more particularly to a heat-sealing apparatus having a plurality of heat-sealing assemblies which are individually rotationally driven to permit efficient operation, and adjustment of the predetermined spacing of heat-seals formed between adjacent ones of the articles being packaged.

BACKGROUND OF THE INVENTION

Many food items, such as stacks or bricks of cheese and the like, are typically packaged on an automatic, horizontal film wrapping machine, a so-called flow wrapper machine. This machine takes articles and wraps film around them, seals longitudinally, and then cross seals and cuts between each article. This type of apparatus includes an arrangement whereby the individual articles to be packaged are positioned in spaced relationship on a heat-sealable web, typically polymeric film. The web with the articles positioned thereon is advanced through the apparatus to form a longitudinal heat-seal along the length of the web, which heat-seal eventually forms a longitudinal heat-seal of each of the packages being formed.

Thereafter, the web and spaced-apart articles are advanced to a heat-sealing apparatus which forms transverse heat-seals at predetermined intervals, thereby forming upper and lower heat-seals for each of the articles being packaged. The machine typically has a multi-head variable pitch die cutting wheel. Its main advantage is an extended sealing time to ensure good seal quality. The cutting mechanism of the apparatus cuts the individual, sealed articles from the web for subsequent packaging, storage and shipment.

Current designs incorporate multiple heads that can be placed at variable intervals to match the pitch of the article. This is accomplished through an intermittent release mechanism. The heads grab the wheel of the machine with a sprag-type clutch device. Each head also incorporates a friction brake to keep the heads moving. The heat is controlled through wipers rubbing powered rings on the wheel. There is no independent temperature control. The opening and closing of the dies are controlled by a 3-dimensional cam path between forked rollers on a simple pivot. Jams can cause the machine to come to an abrupt stop. The machine speed is limited by seal time, head placement, and excessive vibration.

SUMMARY OF THE INVENTION

The present invention is directed to a heat-sealing apparatus of a flow wrapper machine which facilitates efficient, reliable and versatile operation. Notably, the apparatus includes multiple ring gears driven by multiple servo motors in a desirably compact configuration, with the arrangement including quickly removable heat-sealing die heads for efficient operation and service.

An improved drive mechanism facilitates more accurate heat-sealing head placement, smoother operation, controlled stops, independent temperature control, and continuous running through die jams. Also included is a four-bar link on the heat-sealing head for opening and closing the heat-sealing dies.

The main drive consists of individual ring gear or gears connected to each heat-sealing head with a bolt or a quick release holding the die. Each of the ring gears is driven by a pinion gear attached to the pinion shaft connected to the drive motor. To support the ring gears, each ring gear rides on idler gears or wheels on the other pinion shafts. The rings gears are close together to support all the heat-sealing heads.

Cams on the machine open and close the heat-sealing dies. The heat-sealing heads are driven independently by each motor to make for a smooth motion that aligns the heads between each article. This continuous motion gives the machine the ability to run faster and more accurately. The four-bar link gives the ability to make the cam track flat and reproduce the same motion with each machine. It is also able to use a cam path diverter to open the dies if there is a jam in the die and for the machine to continue to run and divert the double pack later downstream.

In accordance with the illustrated embodiment, a heat-sealing apparatus for handling a plurality of articles carried on a heat-sealable web is disclosed. The apparatus includes a plurality of ring gear members arranged in parallel relationship with each other for rotation about a central axis.

The apparatus further includes a plurality of heat-sealing assemblies, each mounted on the periphery of a respective one of the ring gear members for rotation therewith. Each of the heat-sealing assemblies is movable between opened and closed positions for effecting heat-sealing of the web between adjacent ones of the articles carried by the heat-sealable web. A rotary electrical union provides power to each of the rotating heat-sealing assemblies, with the controls of the apparatus preferably configured to permit individual temperature control of the assemblies.

A plurality of drive spindles are positioned within the plurality of ring gear members for guiding rotational movement of the ring gear members. Notably, each of the drive spindles is operatively connected to a single, respective one of the ring gear members, so that together the drive spindles drive the ring gear members about the central axis.

Operation of the apparatus is provided by a plurality of servo drive motors respectively connected to the drive spindles. By this arrangement, operation of the drive motors drives the drive spindles and the ring gear members to advance the heat-sealing assemblies about the central axis of the apparatus, to thereby draw the heat-sealable web and the articles through the apparatus. As will be appreciated, selective operation of the drive motors positions the heat-sealing assemblies at predetermined intervals to heat-seal the web for heat-sealing the articles carried on the web. In the preferred form, each heat-sealing assembly is configured to cut the heat-sealed web at the predetermined intervals between the articles being wrapped, whereby the individual sealed articles are separated from the web for subsequent packaging, storage and shipment. Spacing between individual ones of the heat-sealing assemblies can be selectively varied during each cycle of the machine to achieve the desired formation of the transverse heat-seals while assuring smooth and reliable operation of the apparatus.

In the preferred embodiment, each of the heat-sealing assemblies comprises a four-bar linkage to permit movement of each heat-sealing assembly between opened and closed position by actuation from a two-dimensional cam. In the illustrated embodiment, the apparatus includes a diverter for engagement with at least one of the heat-sealing assemblies to move that one of the heat-sealing assemblies to the opened position to facilitate service of the apparatus. As noted, this diverter acts to open one or more of the heat-sealing assemblies if there is a jam or other malfunction, while permitting the apparatus to operate, and to divert any improperly packaged articles later downstream in the packaging process.

Service to the apparatus is facilitated by mounting each of the heat-sealing assemblies on the respective one of the ring gear members by a quick-release mechanism.

To ensure smooth and reliable operation, each of the drive spindles comprises a plurality of idler gears for non-driven engagement with the ring gear members to which that one of the drive spindles is not operatively connected.

Other features and advantages will be readily apparent from the following detailed description and accompanying drawings. For clarity, the drawings illustrate the invention without every component in every view, and include exploded and fragmentary views.

DETAILED DESCRIPTION OF THE INVENTION

Figure 1:
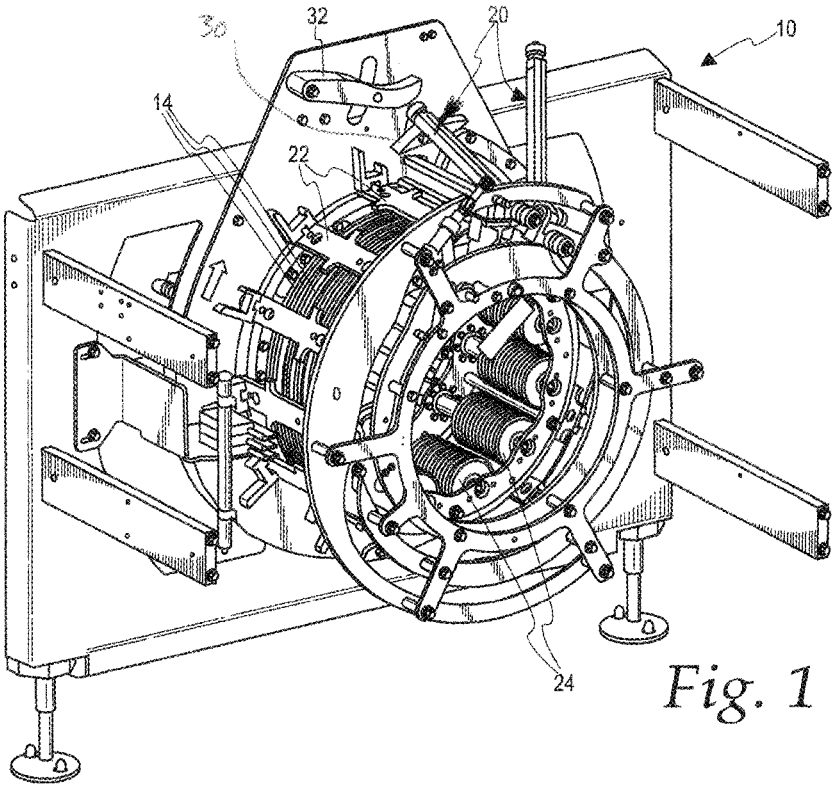
FIG. 1 is a diagrammatic perspective view, partially cutaway, showing a heat-sealing apparatus embodying the principles of the present invention.
Figure 2:
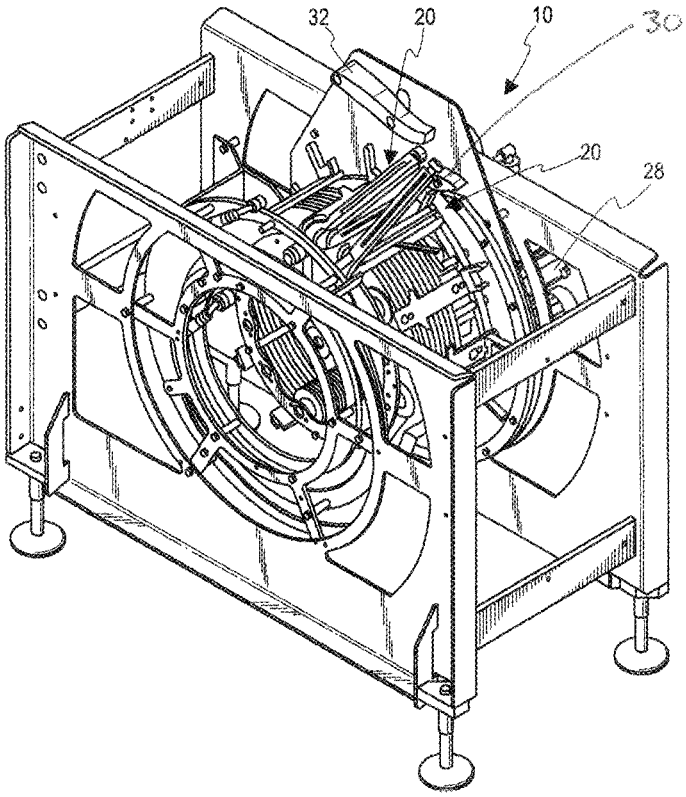
FIG. 2 is another diagrammatic perspective view of the heat-sealing apparatus shown in FIG. 1.
Figure 4:
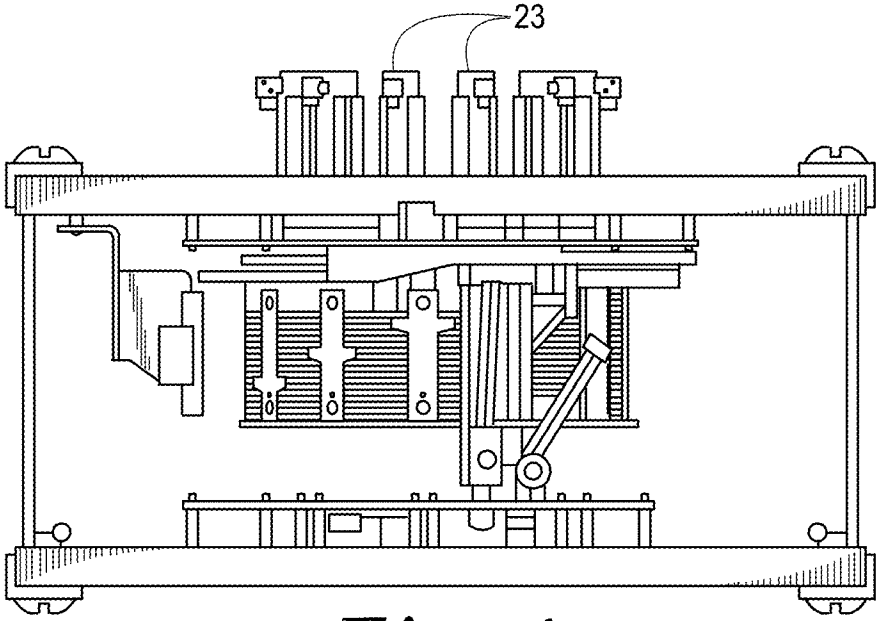
FIG. 4 is a top plan view of the present heat-sealing apparatus.
Figure 3:
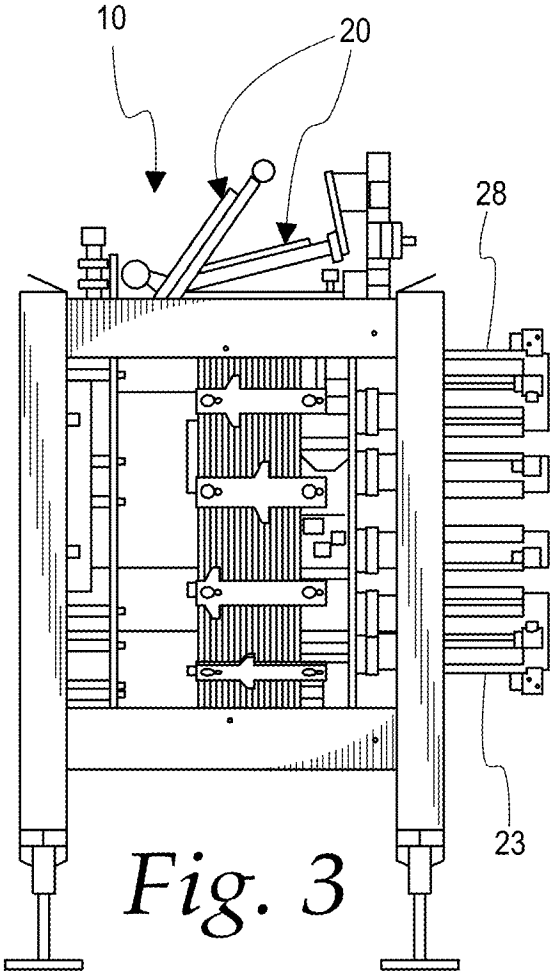
FIG. 3 is a side elevational view of the present heat-sealing apparatus.
Figure 6:
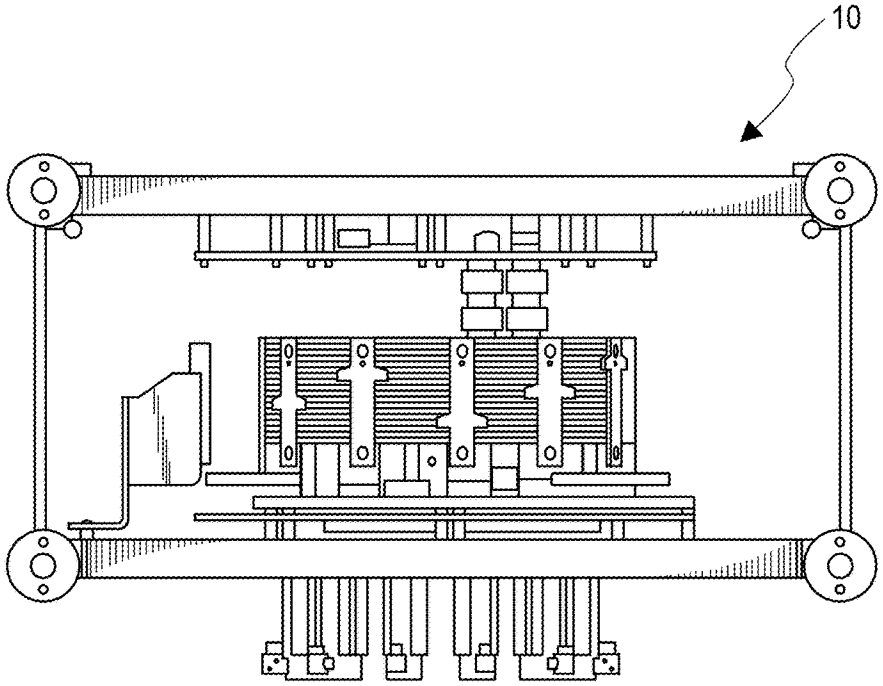
FIG. 6 is a bottom plan view of the present heat-sealing apparatus.
Figure 5:
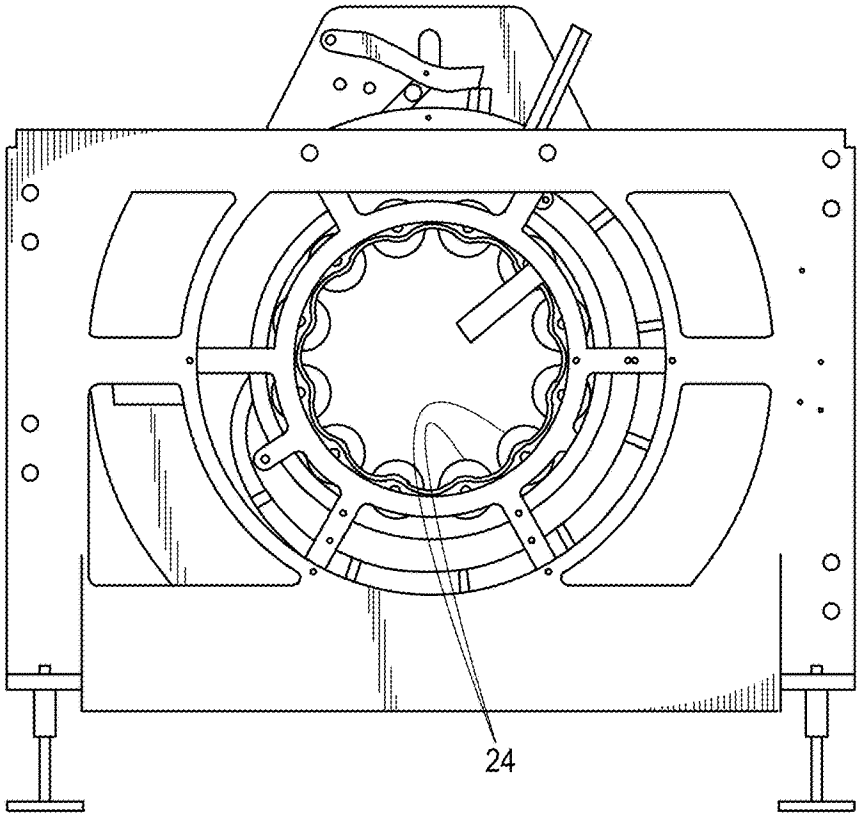
FIG. 5 is a front elevational view of the present heat-sealing apparatus.
Figure 7:
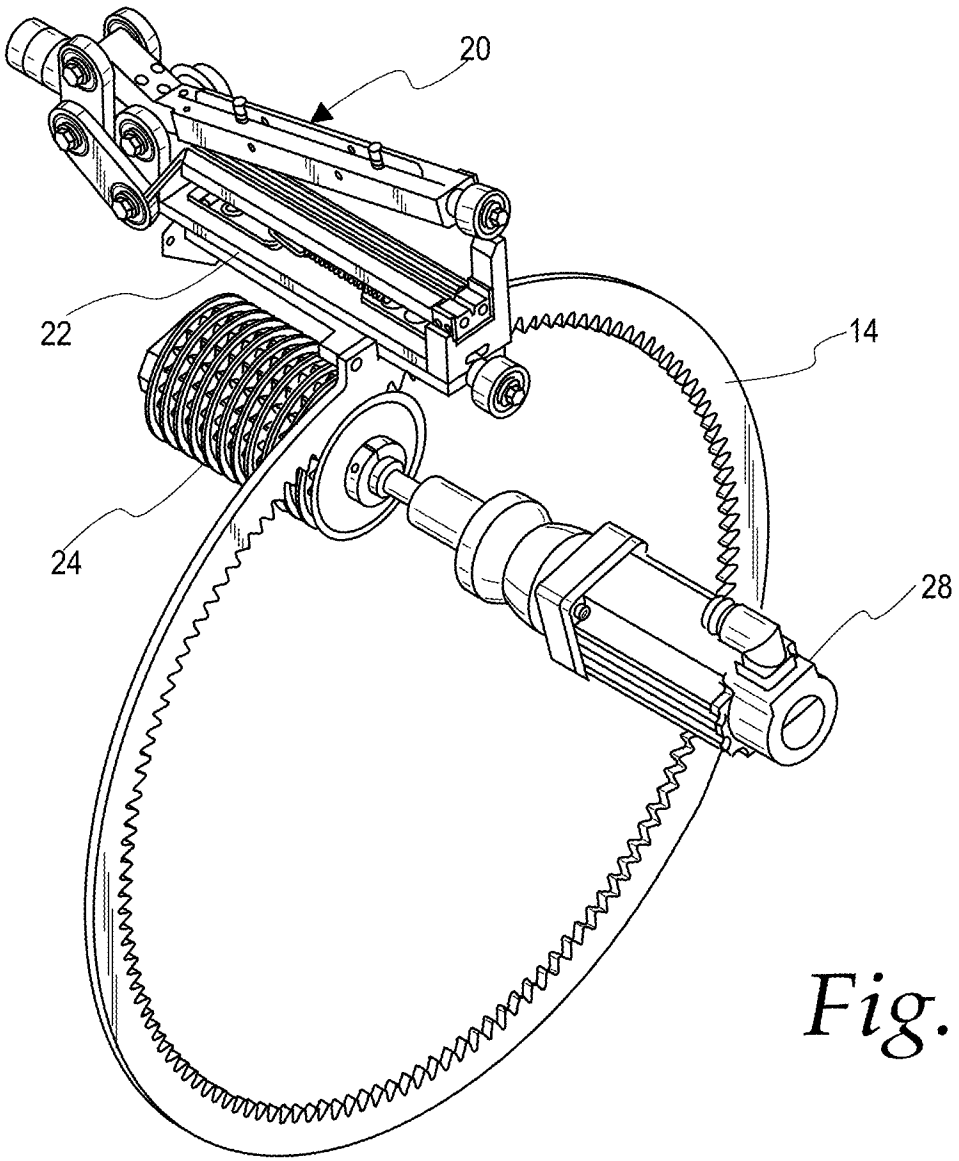
FIG. 7 is a diagrammatic view of the servo-drive arrangement of the present heat-sealing apparatus.
Figure 8:
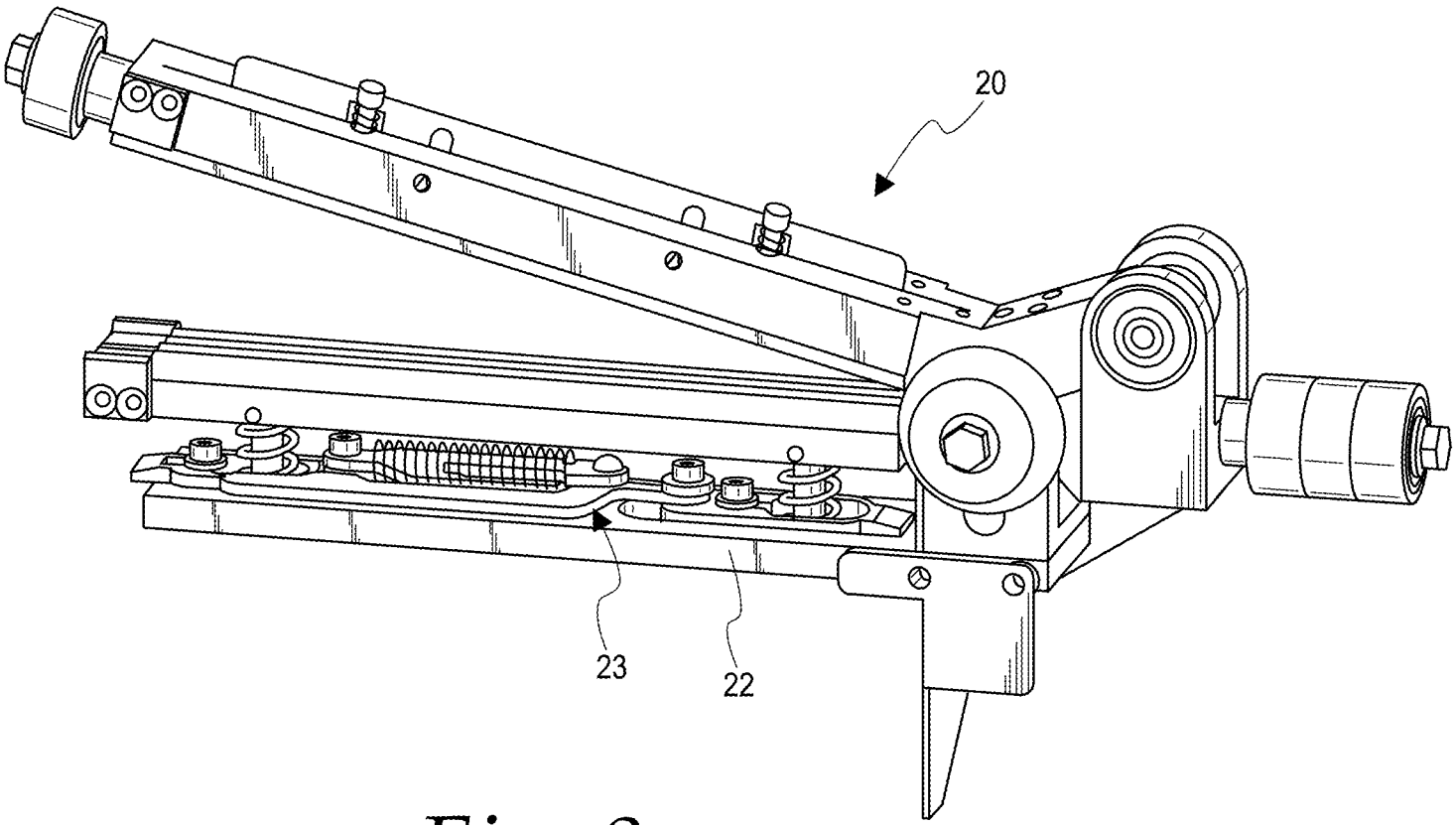
FIG. 8 is a diagrammatic perspective view of a heat-sealing assembly of the present heat-sealing apparatus.

While the present invention is susceptible to embodiment in various forms, there is shown in the drawings and hereinafter described a presently preferred embodiment, with the understanding that the present disclosure should be considered as an exemplification of the invention, and is not intended to limit the invention to the specific embodiment illustrated.

The present invention is directed to a heat-sealing apparatus, designated 10, of a flow wrapper machine which facilitates efficient, reliable and versatile operation. Notably, the apparatus 10 includes multiple ring gears driven by multiple servo motors in a desirably compact configuration, with the arrangement including quickly removable heat-sealing die heads for efficient operation and service.

An improved drive mechanism facilitates more accurate heat-sealing head placement, smoother operation, controlled stops, independent temperature control, and continuous running through die jams. Also included is a four-bar link on the heat-sealing head for open and closing the heat-sealing die.

As will be further described, the main drive consists of individual ring gears connected to each heat-sealing head with a bolt and a quick release holding the die. Each of the ring gears is driven by a pinion gear attached to the pinion shaft connected to the drive motor. To support the ring gears, each ring gear rides on idler gears or wheels on the other pinion shafts. The rings gears are close together to support all the heat-sealing heads.

Cams on the machine open and close the heat-sealing dies. The heat-sealing heads are driven independently by each motor to make for a smooth motion that aligns the heads between each article. This continuous motion gives the machine the ability to run faster and more accurately. The four-bar link gives the ability to make the cam track flat and reproduce the same motion with each machine. It is also able to use a cam path diverter to open the dies if there is a jam in the die and for the machine to continue to run and divert the double pack later downstream.

In accordance with the illustrated embodiment, a heat-sealing apparatus 10 for handling a plurality of articles carried on a heat-sealable web is disclosed. The apparatus 10 includes a plurality of ring gear members 14 arranged in parallel relationship with each other for rotation about a central axis.

The apparatus 10 further includes a plurality of heat-sealing assemblies 20, each mounted on the periphery of a respective one of the ring gear members 14 by a mounting plate 22 for rotation therewith. Each of the heat-sealing assemblies 14 is movable between opened and closed positions for effecting heat-sealing of the web between adjacent ones of the articles carried by the heat-sealable web.

A plurality of drive spindles 24 are positioned within the plurality of ring gear members 14 for guiding rotational movement of the ring gear members 14. Notably, each of the drive spindles 24 is operatively connected to a single, respective one of the ring gear members 14, so that together the drive spindles 24 drive the ring gear members 14 about the central axis of the apparatus.

Operation of the apparatus 10 is provided by a plurality of servo drive motors 28 respectively connected to the drive spindles 24. By this arrangement, operation of the drive motors 28 drives the drive spindles 24 and the ring gear members 14 to advance the heat-sealing assemblies 20 about the central axis of the apparatus, to thereby draw the heat-sealable web and the articles through the apparatus.

As will be appreciated, selective operation of the drive motors 28 positions the heat-sealing assemblies 20 at predetermined intervals to heat-seal the web to thereby heat-seal the articles carried on the web. In the preferred form, each heat-sealing assembly 20 is configured to cut the heat-sealed web at the predetermined intervals between the articles being wrapped, whereby the individual sealed articles are separated from the web for subsequent storage and shipment. Spacing between individual ones of the heat-sealing assemblies 20 can be selectively varied during each cycle of the machine to achieve the desired formation of the transverse heat-seals while assuring smooth and reliable operation of the apparatus 10.

In the preferred embodiment, each of the heat-sealing assemblies 20 comprises a four-bar linkage to permit movement of each heat-sealing assembly 20 between opened and closed position by actuation from a two-dimensional cam 30. In the illustrated embodiment, the apparatus includes a diverter 32 for engagement with at least one of the heat-sealing assemblies 20 to move that one of the heat-sealing assemblies to the opened position to facilitate service of the apparatus. As noted, this diverter 32 acts to open one or more of the heat-sealing assemblies if there is a jam or other malfunction, while permitting the apparatus to operate, and to divert any improperly packaged articles later downstream in the packaging process.

Service to the apparatus is facilitated by mounting each of the heat-sealing assemblies 20 on the mounting plate 22 of the respective one of the ring gear members by a quick-release mechanism 23.

To ensure smooth and reliable operation, each of the drive spindles comprises a plurality of idler gears for non-driven engagement with the ring gear members to which that one of the drive spindles is not operatively connected.

From the foregoing, it will be observed that numerous modifications and variations of the present invention can be effected without departing from the true spirit and scope of the novel concept of the present invention. It is to be understood that no limitation with respect to the specific embodiment illustrated is intended not should be inferred. The disclosure is intended to cover, by the appended claims, all such modifications that fall within the scope of the claims.

The invention claimed is:

1. A heat-sealing apparatus for handling a plurality of articles carried on a heat-sealable web, comprising:

a plurality of ring gear members arranged in parallel relationship with each other for rotation about a central axis;

a plurality of heat-sealing assemblies each mounted on the periphery of a respective one of said ring gear members for rotation therewith, each of said heat-sealing assemblies being movable between opened and closed positions for effecting heat-sealing of said web between adjacent ones of said articles carried by said heat-sealable web;

a plurality of drive spindles positioned within said plurality of ring gear members for guiding rotational movement of said ring gear members, each of said drive spindles being operatively connected to a respective one of said ring gear members so that said drive spindles drive said ring gear members about said central axis; and a plurality of drive motors respectively connected to said drive spindles, so that operation of said drive motors drives said drive spindles and said ring gear member to advance said heat-sealing assemblies about said central axis to draw said heat-sealable web and said articles through said apparatus;

whereby selective operation of said drive motors positions said heat-sealing assemblies at predetermined intervals whereupon the heat-sealing assemblies can be operated to heat-seal said web to thereby effect heat-sealing of the articles carried on said web.

2. A heat-sealing apparatus in accordance with claim 1, wherein each of said heat-sealing assemblies comprises a multi-bar linkage configured to permit movement of each heat-sealing assembly between opened and closed position by actuation through a cam.

3. A heat-sealing apparatus in accordance with claim 2, wherein said apparatus includes a diverter for engagement with at least one of said heat-sealing assemblies to move that one of the heat-sealing assemblies to the opened position to facilitate service of said apparatus.

4. A heat-sealing apparatus in accordance with claim 1, wherein each of said heat-sealing assemblies is mounted on the respective one of said ring gear members by a quick-release mechanism to facilitate service of said apparatus.

5. A heat-sealing apparatus in accordance with claim 1, wherein each of said drive spindles comprises a plurality of idler gears for non-driven engagement with the ring gear members to which that one of the drive spindles is not operatively connected.

* * * * *